US007044831B2

(12) United States Patent
Gabriel et al.

(10) Patent No.: US 7,044,831 B2
(45) Date of Patent: May 16, 2006

(54) MULTI-PORT SANDBLASTING MANIFOLD AND METHOD

(75) Inventors: Mark F. Gabriel, Renton, WA (US); Robert C. Larsen, Bonney Lake, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/796,080

(22) Filed: Mar. 10, 2004

(65) Prior Publication Data

US 2005/0202755 A1 Sep. 15, 2005

(51) Int. Cl.
*B24B 49/00* (2006.01)
*B05B 7/00* (2006.01)

(52) U.S. Cl. ..... 451/5; 451/102; 451/99; 222/630

(58) Field of Classification Search ..... 451/5, 451/102, 99, 89; 222/630
See application file for complete search history.

(56) References Cited

U.S. PATENT DOCUMENTS 2,195,810 A * 4/1940 Bower ..... 451/80
3,815,286 A * 6/1974 Piet ..... 451/90
3,857,409 A * 12/1974 Aubrey et al. ..... 137/412
4,492,575 A * 1/1985 Mabille ..... 433/88
5,031,373 A * 7/1991 Montgomery ..... 451/38
5,038,527 A * 8/1991 Fastje ..... 451/89
5,216,849 A 6/1993 Clack et al. ..... 51/417
5,415,584 A * 5/1995 Brooke et al. ..... 451/99
5,544,810 A * 8/1996 Horvath et al. ..... 239/10
5,643,057 A 7/1997 Isaacson ..... 451/81
5,681,132 A * 10/1997 Sheppard, Jr. ..... 406/61
5,947,796 A * 9/1999 Imayama et al. ..... 451/2
6,062,957 A 5/2000 Klaft et al. ..... 451/102
6,361,416 B1 * 3/2002 Hopkins et al. ..... 451/88
6,712,677 B1 * 3/2004 Williams et al. ..... 451/89

* cited by examiner

*Primary Examiner*—David B. Thomas
*Assistant Examiner*—Alvin J. Grant
(74) *Attorney, Agent, or Firm*—Baker & Hostetler LLP

(57) ABSTRACT

A method and apparatus is provided to simplify sandblasting processes while increasing applied coverage areas in sandblasting operations. The method and apparatus provide a manifold assembly having a plurality of nozzles and that is rigidly attached to an air supply. The manifold is supplied with abrasive material via a plurality of angularly attached sand supply hoses which are coupled to an abrasive material supply. The manifold assembly is pressurized with the supply of air. An article is sandblasted by drawing sand through the hoses and out of the plurality of nozzles using the pressurized air through the manifold assembly.

12 Claims, 6 Drawing Sheets

MULTI-PORT SANDBLASTING MANIFOLD AND METHOD

FIELD OF THE INVENTION

The present invention relates generally to creating a desired texture on the face of an object. More particularly, the present invention relates to a method and apparatus for abrasive blasting of the face of an object to give it a desired uniform appearance.

BACKGROUND OF THE INVENTION

Abrasive blasting, commonly referred to as sandblasting, has been widely utilized in industry as a method for cleaning and deburring objects. Applications of abrasive blasting may include methods to prepare surfaces with attractive finishes or to texturize the finish material of a surface. In other applications, surfaces of articles may require sandblasting to remove scale or debris from a product. In yet another application, sandblasting techniques may be employed in order to enhance the finish of a product surface, for example, to improved paint adhesion of the product surface. For proper adhesion of coatings, it is sometimes preferable to completely clean the exterior surface of a product and in some instances preferably roughen the surface via abrasion or by surface etching.

It may be important to consider several factors when employing sandblasting techniques in abrasive blasting operations. For example, one consideration may include preparing a texturized surface such that it is treated to have a uniform appearance. There have been attempts to achieve this objective in the prior art, but, in some instances, the processes developed have been ineffective or wasteful. For example, an operator may be employed to manually move a sandblasting apparatus back and forth across the face of an article in an effort to treat its surface. Typical sandblasting operations have utilized a sandblasting gun to perform such manual sandblasting procedures. However, this method of texturizing/treating a surface can be expensive due to its labor intensive nature. In addition, in instances where uniformity may be important in the mass production of parts or products, the sandblasting results, in the aforementioned manner, may not be sufficiently uniform from one treated article to another. These variations may result from differences that exist between individual operators as well as variances in each operator's actions from article to article in the sandblasting treatment process.

It may also be important to employ a certain degree of care when performing sandblasting operations on surfaces of articles. For example, when treating relatively thin parts, care should be taken during the sandblasting process in order to avoid unintentional deformations to the part. The likelihood of such deformations can occur with the increased number of passes of a nozzle of a sandblasting gun in various attempts to achieve complete uniform coverage or a desired look and/or texture to the surface of an article. Thus, there is a need for an apparatus and method for removing previous coatings, deposits, rust and/or scale from surfaces of articles which also considers the incorporation and/or placement of sandblasting nozzles. Such care may include limiting the number of passes of a sandblasting nozzle while maximizing the treated sandblasted area.

In a typical abrasive blasting set-up, a sandblasting nozzle is generally provided and coupled to additional hardware components that provide the abrasive particles. A means to stimulate the particles through the nozzle is commonly provided by pressurized air attached to the nozzle. For larger areas of application, a plurality of nozzles may be provided to treat a predetermined area. In this instance, a pressurized air source and a sandblasting particle source would be required for each nozzle to perform the sand blasting operation. In a typical arrangement, an air pressure inlet hose and a sand inlet line are coupled to the nozzle such as by clamping means. However, the aforementioned configuration requires additional hardware in order to provide pressurized air and sandblasting material to each nozzle. Additional hardware may also typically include a number of control valves employed, for instance, to regulate the air flow to each nozzle. Thus, this arrangement can be expensive and cumbersome to use due to the additional components required during sandblasting operations.

Accordingly, it would be desirable to provide a method and apparatus that provides extended coverage greater in some instances than would otherwise be obtained by a sandblasting gun or single nozzle. It is also desirable to provide a method and apparatus that treats articles relatively evenly and in a suitably uniform manner without undesirably damaging the article. Finally, a need exists to provide a method and apparatus to simplify the sandblasting procedure and hardware setup including a reduction in the number of control valves as well.

SUMMARY OF THE INVENTION

The foregoing needs are met, to a great extent, by the present invention, wherein in one aspect a method and apparatus are provided that in some embodiments simplifies a sandblasting process while increasing the applied coverage area compared to a single nozzle arrangement.

In accordance with one aspect of the present invention, an apparatus for blasting abrasive material onto an article is provided that in some embodiments includes a manifold assembly, an air supply line connected to the manifold assembly, a plurality of nozzles connected to the manifold assembly, and a plurality of material supply hoses connected to the manifold assembly.

In accordance with another aspect of the present invention, a method of blasting abrasive material onto an article is provided that in some embodiments includes providing a manifold assembly having a plurality of nozzles and providing a supply of abrasive material. An air supply is rigidly attaching to the manifold assembly. The method may also include angularly attaching one end of a plurality of material supply hoses to the manifold assembly and coupling the hoses to the abrasive material supply at their respective other ends. An article may be sandblasted by pressurizing the manifold assembly with the supply of air and sandblasting the article by drawing abrasive material through the hoses and out of the plurality of nozzles using the pressurized air.

In accordance with yet another embodiment aspect of the present invention, a system for blasting abrasive material onto an article is provided that in some embodiments includes a means for supplying air, a means for receiving air rigidly attached to the air supplying means, a means for supplying the abrasive material to the air receiving means, and a means for directing the abrasive material towards the article.

In accordance with yet still another aspect of the present invention, a system for blasting abrasive material onto an article is provided that in some embodiments includes a compressed air supply, a supply of abrasive material, and a manifold assembly. The system may further include an air supply line coupled to the compressed air supply and further connected to the manifold assembly. Additionally, the system may further provide a plurality of sand supply hoses connected to the manifold assembly and further coupled to the supply of abrasive material and a plurality of nozzles connected to the manifold assembly to receive and distribute the supply of abrasive material through said manifold assembly.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
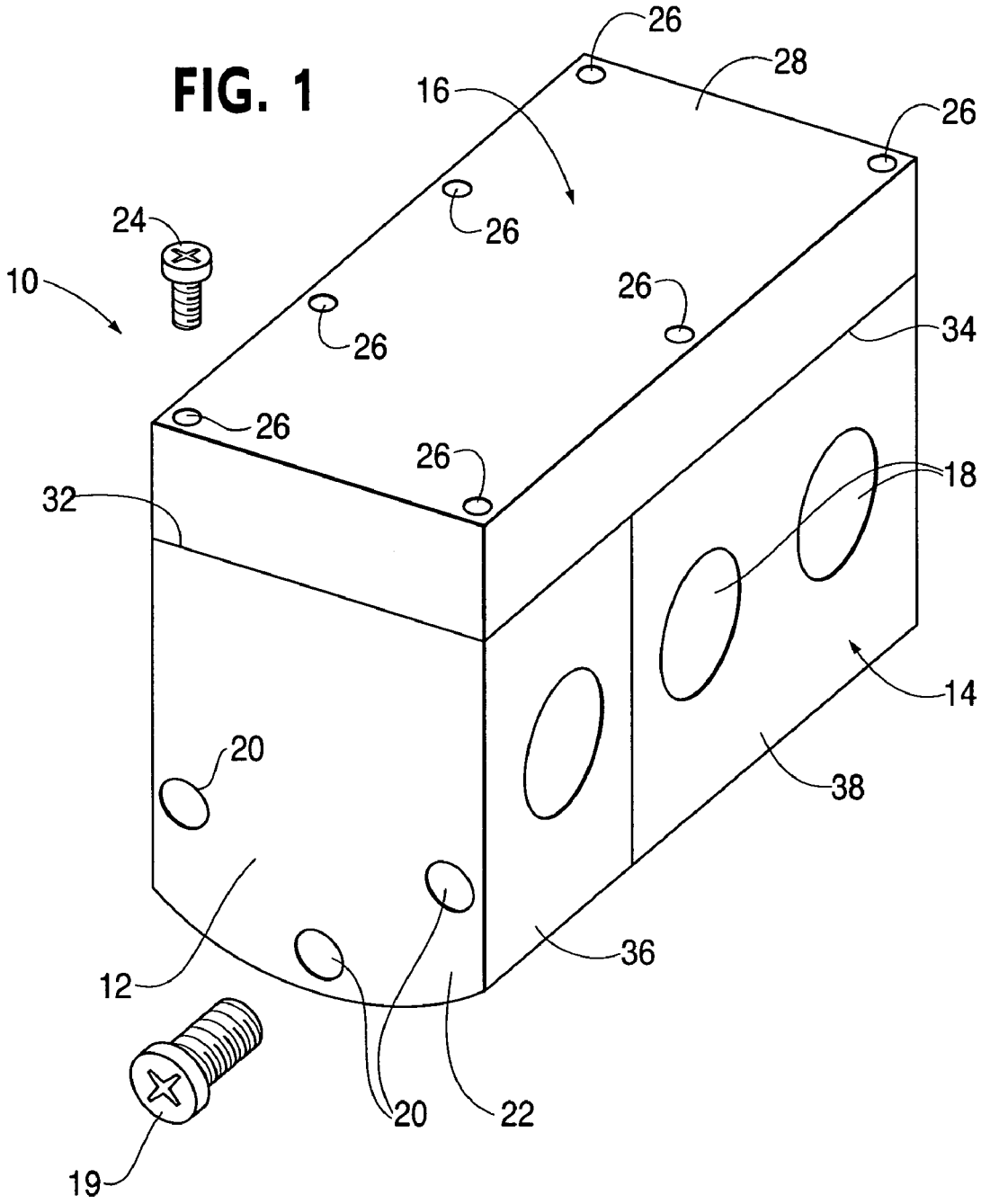
FIG. 1 is a perspective view illustrating an exemplary preferred configuration of a multi-angle multi-port manifold assembly according to one embodiment of the invention.

An embodiment in accordance with the present invention provides a method and apparatus that in some embodiments simplifies the sandblasting process while increasing the applied coverage area in a sandblasting operation compared to a single nozzle arrangement. The invention will now be described with reference to the drawing figures, in which like reference numerals refer to like parts throughout.

An embodiment of the present inventive apparatus is illustrated in FIG. 1., wherein, in one embodiment, a base configuration of a manifold assembly 10 is shown. In this embodiment, the manifold assembly 10 is preferably a multi-angle multi-port manifold assembly comprising a two-piece manifold block 12,14 and a plenum cap 16. However, the manifold block 12,14 may alternatively be manufactured from a single block or other various configurations.

In general, the manifold block 12,14 is a one or multiple piece machined block that acts as a sandblasting manifold. The manifold block 12,14 is preferably machined out of aluminum and has various internal chamber configurations. These chambers form internal passages that terminate with ports where exit the manifold assembly 10. The chambers are configured to receive pressurized air and sandblasting material at an assortment of locations, and to direct them to outlet ports. The configuration of the manifold block 12,14 preferably is designed to generate a venturi effect in these internal chambers by using the pressurized air to create a vacuum in order to suck in sandblasting material through a material inlet port location and further distribute the sand blasting material through nozzles which are configured at an outlet port location and retained upon the manifold block. The nozzles direct the material towards the article being sandblasted.

An embodiment shown in FIG. 1 illustrates a manifold block 12,14 comprising a first chambered block 12 and a second chambered block 14. The first chambered block 12 and the second chambered block 14 may comprise various combinations of material inlet ports 18. These material inlet ports 18 are preferably designed to accommodate attachment of a supply of sandblasting material, such as, for example, sand. In this embodiment, the first chambered block 12 is represented by a single-chambered block, and the second chambered block 14 is comprised of a two-chambered block. Generally, the number of various chambers or ports internally configured into either the first chamber block 12 or the second chambered block 14 is selected based upon the particular sandblasting application.

In the embodiment shown in FIG. 1, the first chambered block 12 is preferably attached to the second chambered block 14 via threaded connectors 19 located through manifold block fastener holes 20. In a preferred embodiment, the manifold block fastener holes 20 are located in a front side surface 22 of the first chambered block 12. The second chambered block 14 is preferably configured to have threaded receiving holes in a corresponding location to receive threaded fasteners 16 when inserted through the manifold block fastener holes 20.

Likewise, the plenum cap 16 is preferably retained to the manifold block via threaded connectors 24 located through plenum cap fastener holes 26. In a preferred embodiment, the plenum cap fastener holes 26 are located through a top surface 28 of the plenum cap 16. Both the first chambered block 12 and the second chambered block 14 are preferably configured to have threaded receiving holes in corresponding locations to the plenum cap fastener holes 26. These corresponding locations are preferably located in a top side location 32, 34 of the first chambered block 12 and the second chambered block 14, respectively. Thus, a connector, such as a threaded fastener 24, may be utilized to retain the plenum cap 16 through the plenum cap faster holes 26 and into the corresponding threaded receiving holes located on the first chambered block 12 and the second chambered block 14.

As shown in FIG. 1, a plurality of sand inlet ports 18 are depicted on the side surfaces 36, 38, 22 of the first chambered block 12 and the second chambered block 14, respectively. In a preferred embodiment of the invention, the material inlet ports 18 are machined into the manifold block angularly to the side surfaces 36, 38 of the first chambered block 12 and the second chambered block 14, respectively.

Figure 2:
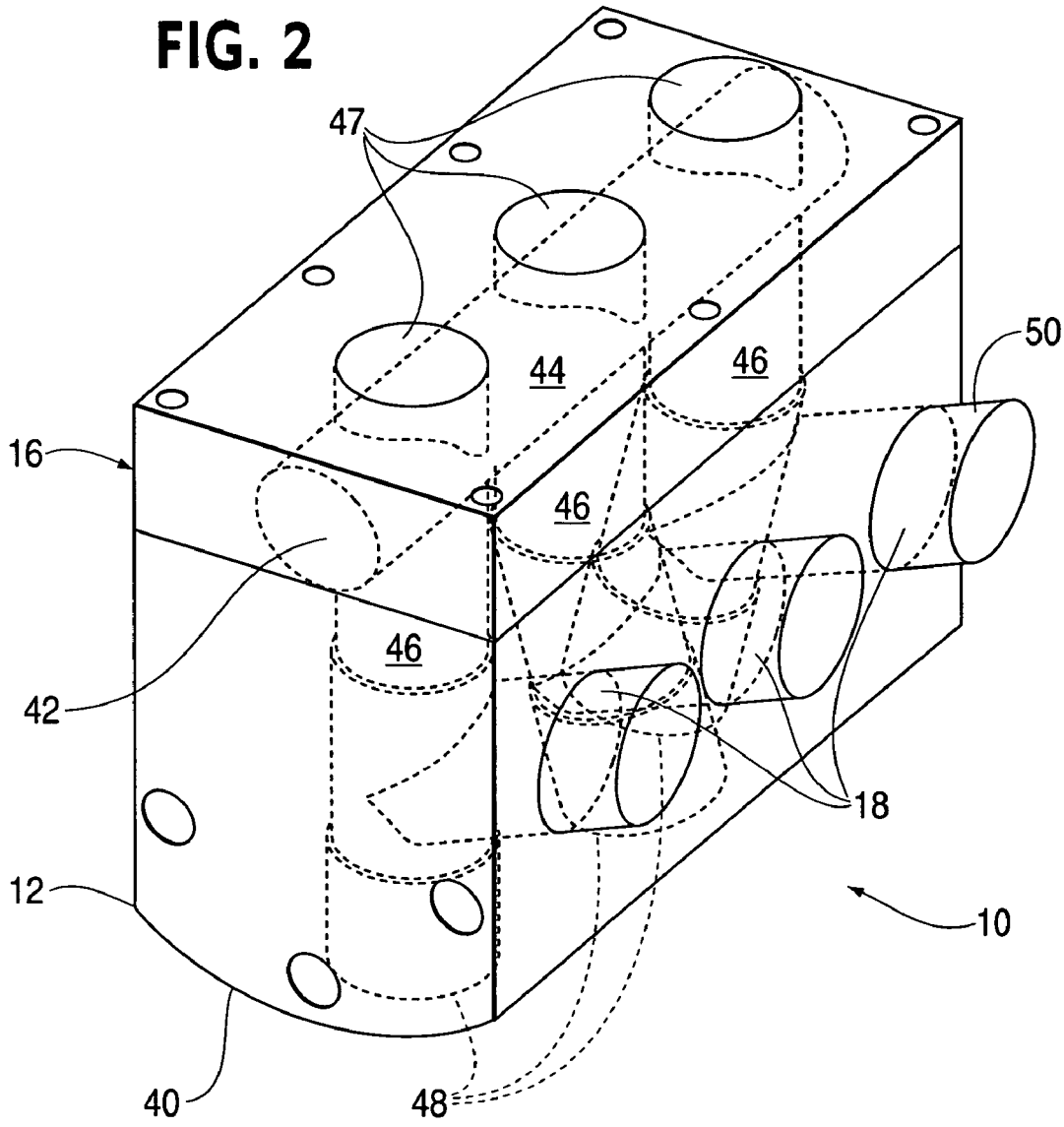
FIG. 2 is a perspective view illustrating an internal configuration of the manifold assembly of FIG. 1.

In FIG. 2., an internal view of various chambers of the manifold assembly 10 is shown. The chambers include an air inlet port 42 leading to an air supply chamber 44, cross chambers 46 that each intersect the air supply chamber 44, material ports 18, and material outlet or nozzle attachment ports 48. For simplicity, the manifold 10 of FIG. 2 is shown with a single bock 12 rather than a two-part block 12, 14 as in FIG. 1.

The air inlet port 42 receives pressurized air from an air pressure source and supplies the air to the cross chambers 46. The air inlet port 42 may be located on an end surface of the manifold assembly 10, or alternatively the air inlet port 42 may be configured to receive air through a top surface of the manifold assembly 10. In a preferred embodiment, the cross chambers 46 are drilled vertically from the top through and intersect with the air inlet chamber 44 and are then plugged at one end 47 to direct air down the cross chambers 46 and out of the material outlet ports 39. The material inlet ports 18 feed into the cross ports 21 prior to a location of the material outlet ports 48.

Most preferably, the sand inlet ports 18 are bored angularly from perpendicular of the side surfaces to intersect a respective cross chamber 46. The angular intersection of the inlet port 18 with the cross chamber 46 facilitates the generation of a venturi effect when pressurized air is supplied to the manifold assembly 10 via the air inlet port 42 into the cross chamber 46 and past the angled intersection of the sand inlet port 18 with the cross chamber 46.

FIG. 2 also shows additional hardware components which are preferably utilized in a sandblasting method of the present invention. Sand inlet connectors 50 are shown attached at the sand inlet ports 18 in angular arrangement to the side surfaces of the block 12. The sand inlet connectors 50 facilitate coupling sand supply hoses 52 to the manifold assembly 10 by connecting an end of the hoses 52 to a respective end of sand inlet connectors 50. The other end of the hoses 52 may be collectively inserted in to a supply of any appropriate abrasive material utilized in sandblasting operations. Alternatively, each hose 52 may be inserted into a different supply of abrasive material or a combination thereof. With the hoses 52 attached accordingly, the abrasive material is poised to flow into the sand inlet connectors 50 via the supply hoses 52 and into the manifold assembly 10 to perform sandblasting operations when pressurized air is supplied to the manifold assembly 10.

Figure 4:
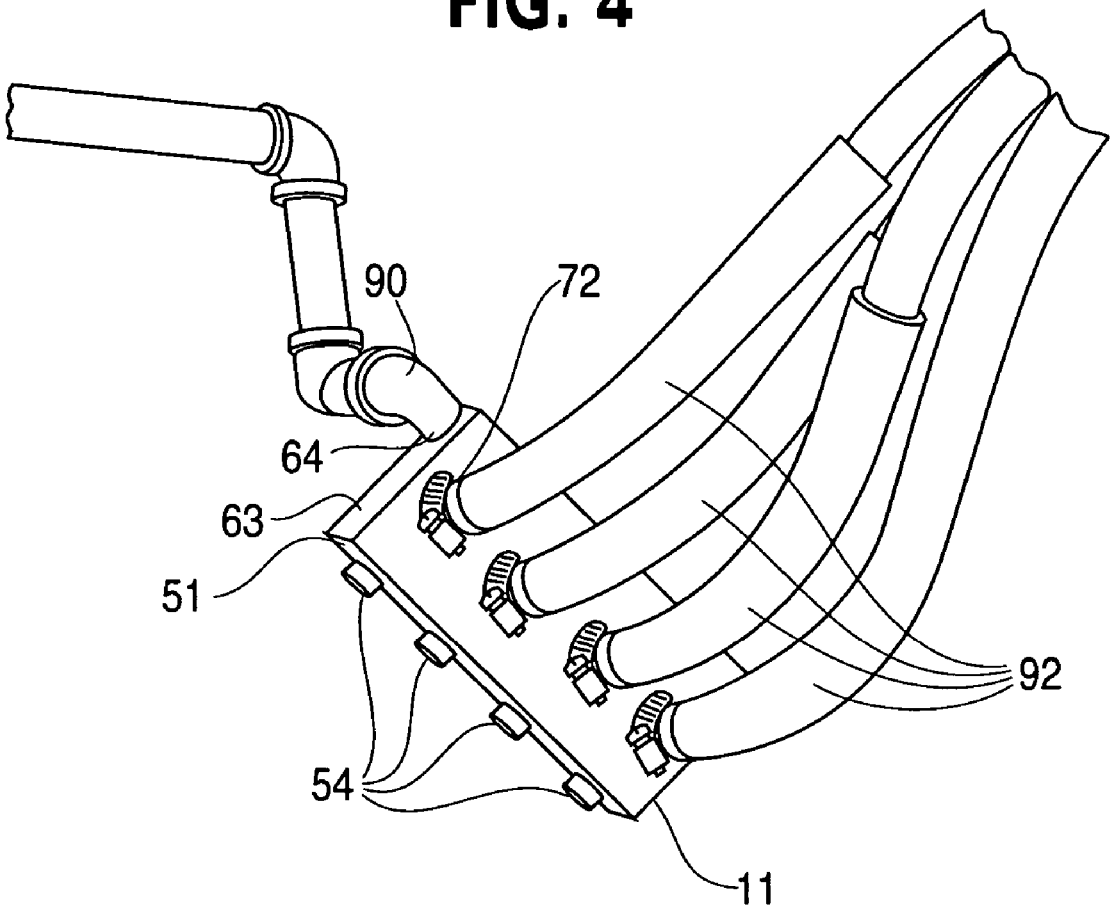
FIG. 4 illustrates a single-angle multi-port sandblast manifold assembly in combination with a boom assembly according to one embodiment of the invention.

A plurality of nozzles 54 (not shown at FIG. 2, but shown at FIGS. 5 and 6) may be located at the material outlet or nozzle attachment ports 48 to extend from a bottom surface 40 of the manifold block. In a preferred embodiment, the nozzles 54 are mounted to be diverted at multiple differing angles from the bottom surface 40 of the manifold block as shown, for instance in FIG. 5. In a preferred embodiment, the angles of the nozzles 54 are offset approximately 15 degrees from one another. Other nozzle mounting angles may be utilized in accordance with sandblasting requirements. Alternatively, the nozzles 54 may be mounted at a single common angle from the manifold block bottom 51 of another embodiment of a manifold assembly 11 as depicted in FIG. 4, for example. The manifold assembly 10 may support a variety of nozzles at different or single common angles as deemed necessary for the particular sandblasting application. Furthermore, the manifold assembly 10 may support the number of nozzles 54 that best suits the sandblasting process. The use of multiple nozzles 54 on a single manifold assembly 10 tends to facilitate a gain in more application coverage than would otherwise be typically obtained from a single nozzle application such as a sandblasting gun.

Figure 3:
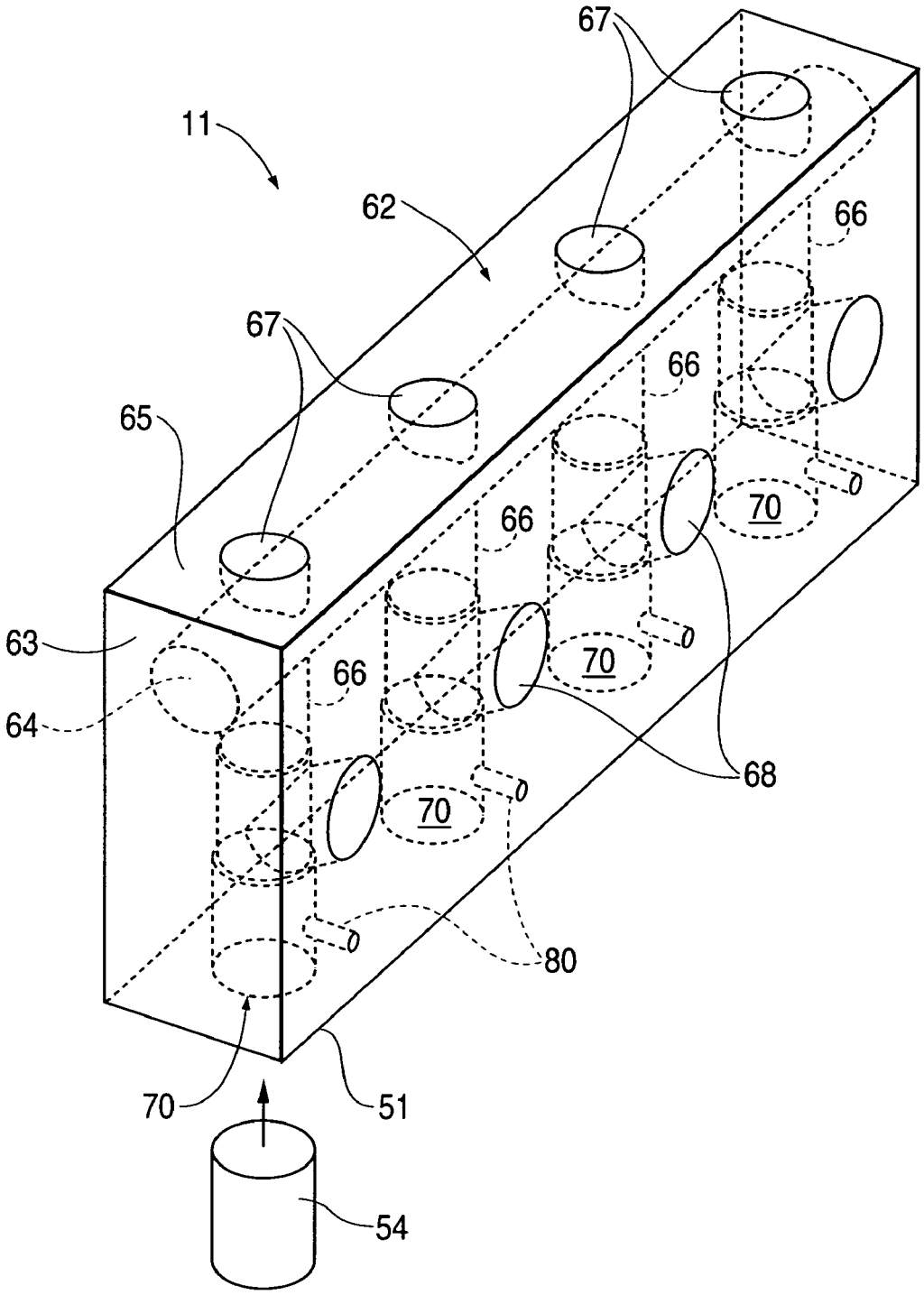
FIG. 3 is perspective view illustrating the internal ports of a single-angle multi port manifold block according to one embodiment of the invention.

In FIG. 3, another embodiment of a manifold assembly 11 is shown as a single-angle multi port manifold block 62. The manifold block 62 is comprised of a single piece in this embodiment. An internal view of various ports is shown. The ports include an air inlet port 64, cross chambers 66, material inlet ports 48, and outlet or nozzle attachment ports 70.

Figure 5:
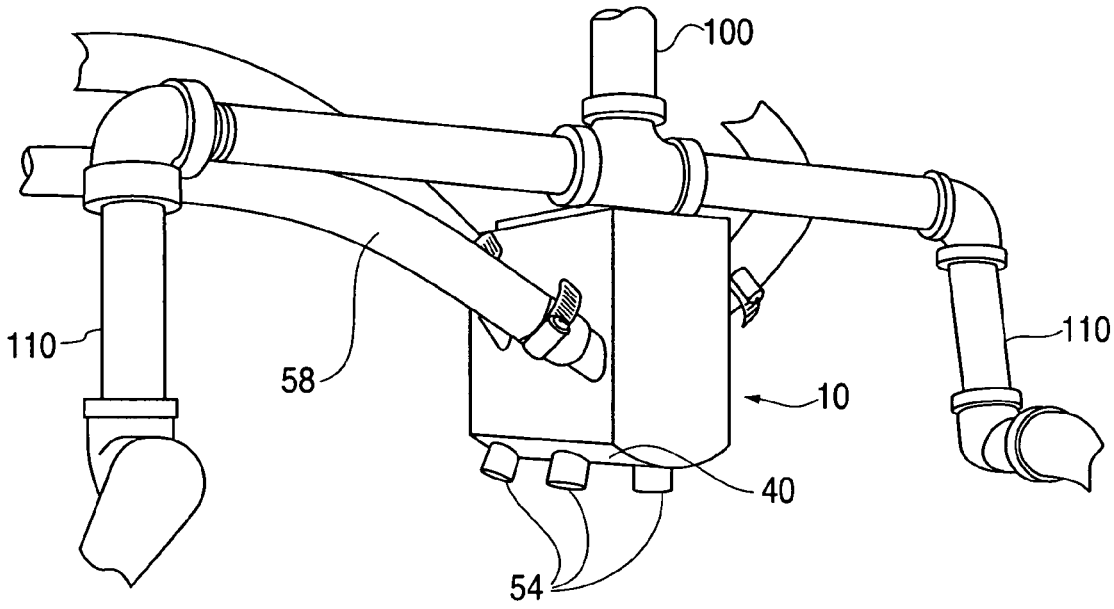
FIG. 5 illustrates a multi-angle sandblast manifold assembly in combination with a boom assembly according to one embodiment of the invention.

In this embodiment, the air inlet port 64 receives pressurized air from an air pressure source and supplies the air to the cross chambers 66. The air inlet port 64 may be located on an end surface 63 of the manifold assembly 11. Alternatively the air inlet port 64 may be configured to receive air through a top surface 65 of the manifold assembly 11 in order to receive pressurized air connected thereto. In a preferred embodiment, the cross chambers 66 receive air from the air inlet port 64 and are plugged therein at one end 67 to direct air down the cross chamber 66 and out of the material outlet ports 50. The material inlet ports 68 feed into the cross chambers 66. As with the embodiment of the manifold assembly 10 shown in FIG. 2, FIG. 5 shows material inlet connectors 72 may also be attached in like manner to the material inlet ports 68 of the manifold assembly 11. Nozzles 54 may also be received by the material outlet attachment ports 70 to direct the sandblasted material. Hence, the nozzle 54 are in direct alignment with an angle of each respective cross chamber 66 and its respective material outlet port 50.

In the embodiment shown in FIG. 3, the cross chambers 66 intersect the air inlet port 64 at approximately 90 degrees. This, in effect, directs sandblasting material out of each outlet port 50 and through the inserted nozzle 54 at the same angle from a bottom surface 51 of the manifold block 62. Alternatively, any or all of the cross chambers 66, may intersect the air inlet port 44 at another angle. FIG. 3 shows on e of the four nozzles 54 an exploded view. If all cross chambers 66 are parallel to each other, any nozzle 54 attached to a respective outlet port 50 of this configuration will direct sandblasting material at the same angle from the bottom surface 51 of the manifold block.

Alternatively the direction of the cross chambers 46, outlet ports 50 and/or nozzles 54 can be non-parallel to each other. For example, the nozzles 54 may be designed to angle outwardly from a bottom surface 40 of the manifold assembly 10 as shown, for instance, in the multi-angle design of FIG. 5. Alternatively the nozzles 54 may be attached to the bottom 51 of the manifold assembly 11 in a single common angle design as shown, for instance, in FIG. 4. Thus various embodiments of the manifold assembly 10,11 can support a variety of nozzle attachment angles in accordance with predetermined sandblasting requirements. The angles of the nozzles can be selected as such to provide complete and uniform coverage of a part given a variety of sandblasting applications.

In a preferred embodiment, the nozzles 54 each comprise a carbide insert. The carbide insert is generally hard and provides extended wear as compared to the preferably aluminum material of the manifold block 10, 11. Most preferably, in one example, the nozzles comprise a ⅜ inch diameter fitting having a 3/16 inch diameter bore therethrough. The length of the nozzle, in this example, is approximately 1 1/14 inch to 1 ½ inch long. As seen in FIG. 3, the nozzles 54 can be mounted to the manifold block 11 by inserting an end thereof into a respective material outlet port 70. Nozzle retainer screws may be used through threaded holes 80 provided in the side of the manifold block in order to retain the nozzles 54 in the sand outlet ports 70 via a device such as a setscrew. The manifold block 12, 14 of the manifold assembly 10 may also be configured with similar setscrew arrangements in the side of the manifold block.

Figure 6:
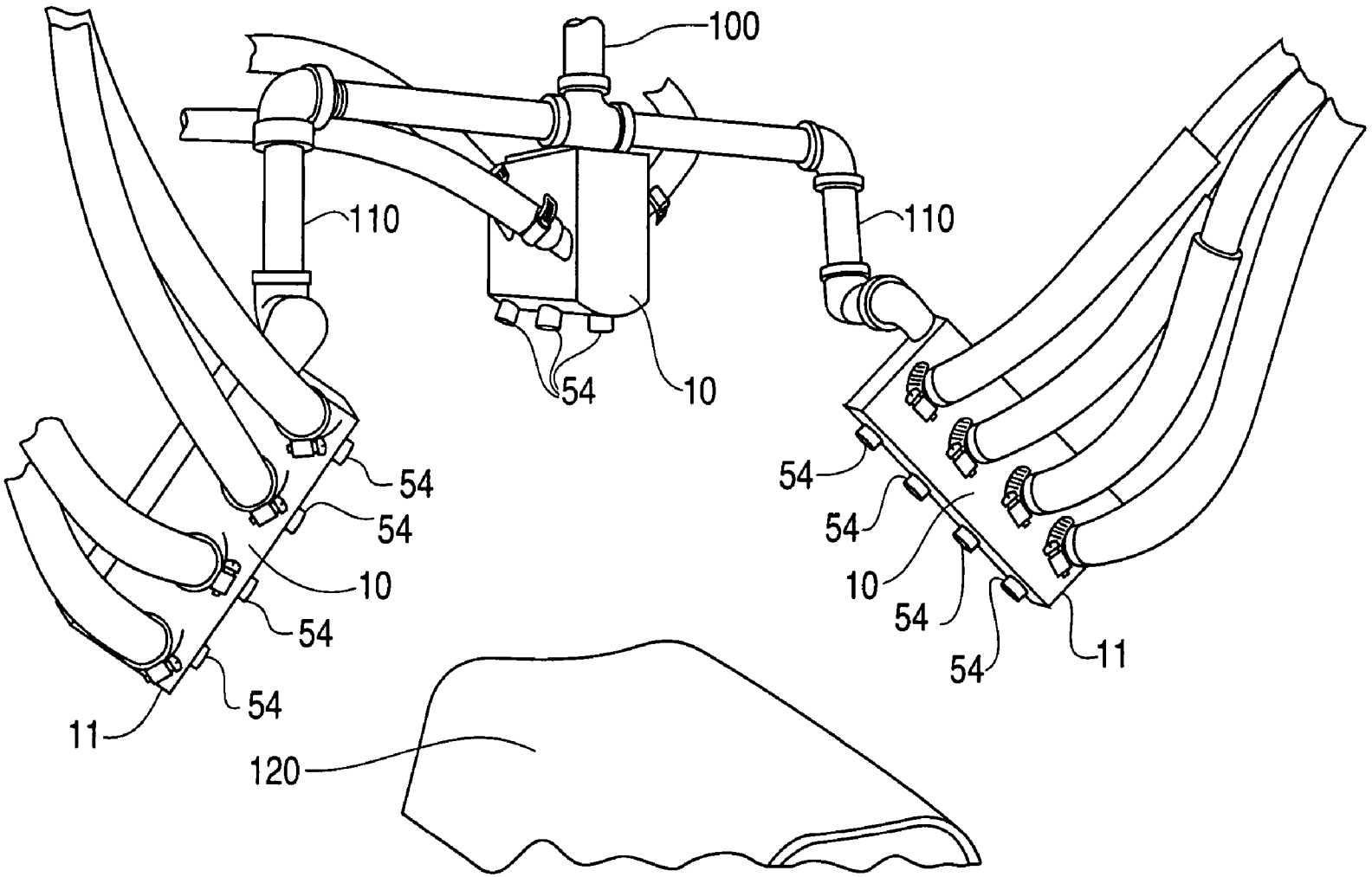
FIG. 6 illustrates a plurality of manifold assemblies all of which are coupled to a boom assembly according to another embodiment of the invention.

In some embodiments, a single air supply source may be rigidly attached directly to the manifold assembly 10, 11, for example, via the plenum cap 16, which provides the benefit of eliminating the need for a separate air supply line for each nozzle. This arrangement also has an added advantage in that the number of control valves, for example, to otherwise regulate each air pressure supply, can be reduced as well. In some preferred embodiments of the invention, for example as shown in FIGS. 4–6, a rigid air supply line 90 is utilized as the primary structure to hold one or more manifold assemblies 10, 11 in position for a sandblasting procedure. This embodiment of the present invention provides an advantage over the prior art, for example, because it simplifies the sandblasting system by eliminating at least some additional mounting hardware.

FIG. 4 illustrates a single-angle multi port manifold 11 with a rigid air supply line 90 connected to the manifold assembly 11 at the air inlet port 64. The rigid air supply line 90 acts as a boom assembly to directly support the manifold assembly. In the embodiment shown in FIG. 4, the rigid air supply line 90 is mounted at an end face 63 of the manifold 11. Preferably the air supply line 90 is ¾ inch pipe. Sand supply hoses 92 are connected to the material inlet attachment ports 72. Threaded clamps may be used to retain the sand supply hoses 92 to the sand inlet attachment ports 72 in an embodiment of the invention. The sand supply hoses 92 are fed from an abrasive material supply such as a hopper storage bin. The abrasive material may comprise any of a variety of elements having desired abrasive or other characteristics including, for instance, silicone carbide, aluminum oxide, walnut shells, and the like. It is possible to configure the sand supply hoses 92 to feed different abrasive materials into each hose by directing each hose to a different supply bin.

When air flows from the air inlet port 64 and down the internal cross chambers, a vacuum effect is created which draws the abrasive material into the material supply hoses 92 and down to the material outlet attachment ports and out of the nozzles 54 in a simultaneous manner to produce the effect of separate sandblasting guns operating at the same time.

FIG. 5 illustrates a multi-angle sandblast manifold assembly with a rigid air supply line 100 connected to the manifold assembly 10 at the air inlet port. Again, the rigid air supply line 100 is capable of acting as a boom assembly to directly support the manifold assembly 10. In the embodiment shown, the rigid air supply line 100 is mounted at a top surface of the manifold 10. The illustrated example shows the air supply line 100 having branches 110.

The versatility of utilizing the rigid air supply line 100 is further shown FIG. 6, which illustrates a plurality of manifold assemblies 10, 11 all of which are coupled to the same rigid air supply line 100 source. Air supply line 100 feeds into manifold 10, and also to two branches 110 which each feed to and serve as boom support for a respective manifold 11. In the configuration shown, each manifold assembly is pressurized via the rigid air supply line 100,110 connection to sandblast an article 120. This embodiment further demonstrates an advantage of the present invention by further eliminating the need for multiple individual air supply hoses each mounted to a respective individual nozzle as may be required by the prior art.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A device comprising:

a block;

a longitudinal passage in the block;

a plurality of outlet passages serially connected to the longitudinal passage, wherein each of the plurality of outlet passages are oriented in a different direction relative to a remainder of the outlet passages; and a plurality of material passages, each material passage of the plurality of material passages being in fluid connection with a corresponding outlet passage of the plurality of outlet passages, wherein each material passage intersects the corresponding outlet passage at an angle to generate a venturi effect.

2. The device of claim 1, wherein the manifold assembly further comprises:

a plenum cap attached to the block.

3. The device of claim 2, wherein threaded connectors are used to connect the plenum cap to the block through a top surface of the plenum cap into a surface of the block.

4. The device according to claim 1, wherein the block further comprises:

a plurality of cross chambers intersecting the longitudinal passage, each cross chamber of the plurality of cross chambers having a first end and a second end, wherein each respective cross chamber comprises a respective outlet passage of the plurality of outlet passages disposed at the first end and is closed off at the second end; and the plurality of material passages each angularly intersecting a respective cross chamber.

5. The apparatus of claim 1, further comprising an air supply line rigidly connected to the longitudinal passage.

6. The device of claim 1, wherein the further comprising:

a plurality of material supply lines connected to a respective one of the plurality of material passages.

7. The device of claim 1, wherein the block further comprises:

a second block connected to the first block; and a plenum cap connected to the first block and the second block.

8. The device of claim 7, wherein threaded connectors are used to connect the plenum cap to the first block and the second block through a top surface of the plenum cap into a surface of the first block and the second block.

9. The device of claim 7, wherein the first block is connected to the second block by threaded connectors.

10. The device according to claim 1 further comprising:

a single air inlet;

a plurality of outlet nozzles in fluid connection with the single air inlet, wherein each outlet nozzle is in fluid connection with a respective one of the plurality of outlet passages; and a plurality of material inlets, each material inlet of the plurality of material inlets being in fluid connection with a corresponding outlet nozzle of the plurality of outlet nozzles.

11. The device according to claim 10, wherein the block further comprises:

a plurality of cross chambers intersecting the single air inlet, each cross chamber of the plurality of cross chambers having a first end and a second end, wherein each respective cross chamber comprises a respective outlet nozzle of the plurality of outlet nozzles disposed at the first end and is closed off at the second end; and the plurality of material inlets each angularly intersecting a respective cross chamber.

12. The device of claim 10, further comprising an air supply line rigidly connected to the single air inlet.

* * * * *